US009723930B2

(12) United States Patent
Burch et al.

(10) Patent No.: US 9,723,930 B2
(45) Date of Patent: Aug. 8, 2017

(54) FOOT CARE AND GROOMING APPARATUS THAT CAN BE PLACED UNDERNEATH A MATTRESS OR CUSHION

(71) Applicant: Creekside Creative LLC, Austin, TX (US)

(72) Inventors: William Theodore Burch, Ofallon, MO (US); Kenrick James DuRapau, Austin, TX (US)

(73) Assignee: Creekside Creative, LLC, Austin, TX (US)

( * ) Notice: Subject to any disclaimer, the term of this patent is extended or adjusted under 35 U.S.C. 154(b) by 14 days.

(21) Appl. No.: 14/955,178

(22) Filed: Dec. 1, 2015

(65) Prior Publication Data

US 2016/0286967 A1 Oct. 6, 2016

Related U.S. Application Data

(60) Provisional application No. 62/086,555, filed on Dec. 2, 2014.

(51) Int. Cl.

| | |
|---|---|
| ***A47C 7/62*** | (2006.01) |
| ***A47C 16/02*** | (2006.01) |
| ***A47C 7/72*** | (2006.01) |
| ***A47C 20/00*** | (2006.01) |

(52) U.S. Cl.

CPC ..... *A47C 16/02* (2013.01); *A47C 7/62* (2013.01); *A47C 7/725* (2013.01); *A47C 20/021* (2013.01)

(58) Field of Classification Search

CPC .. A47C 7/62; A47C 7/50; A47C 7/503; A47C 7/52; A47C 9/0056; A47C 16/025; B64D 11/0627

USPC ..... 297/188.01, 423.12, 423.19, 423.24, 297/423.2, 423.34, 423.35, 423.36, 297/423.39, 423.4, 423.44, 423.46

See application file for complete search history.

(56) References Cited

U.S. PATENT DOCUMENTS

| | | | | | |
|---|---|---|---|---|---|
| 195,425 | A | * | 9/1877 | Weddle | A47C 16/025 297/423.39 |
| 371,373 | A | * | 10/1887 | Scarritt | A47C 7/506 297/423.21 |
| 470,688 | A | * | 3/1892 | Lee | A47C 3/027 297/261.1 |
| 866,316 | A | * | 9/1907 | Watson | A47C 7/52 297/423.32 |
| 1,452,915 | A | * | 4/1923 | Kennedy | A47C 20/022 297/423.46 |
| 1,505,829 | A | * | 8/1924 | Warnecke | A47C 7/62 15/265 |
| 2,614,613 | A | * | 10/1952 | Bushong | A47C 16/02 297/183.3 |
| D182,801 | S | * | 5/1958 | Garshof | 297/423.39 |
| 2,884,991 | A | * | 5/1959 | Bloomquist | A47C 7/383 297/377 |

(Continued)

*Primary Examiner* — Jose V Chen

(74) *Attorney, Agent, or Firm* — John M. Lynn

(57) ABSTRACT

An apparatus and method usable for foot care and the storage of foot care products. The apparatus has two pivoting portions that when closed serve as a container for foot care products. When opened, one portion of the apparatus may be inserted under either a bed mattress or cushion to help support the other side of the apparatus as a user performs foot care on the second side of the apparatus.

9 Claims, 4 Drawing Sheets

(56) References Cited

U.S. PATENT DOCUMENTS

| | | | | | |
|---|---|---|---|---|---|
| 3,276,817 | A * | 10/1966 | Marple | A47C 1/146 | 297/283.1 |
| 5,368,367 | A * | 11/1994 | Titchener | A47C 7/52 | 297/423.1 |
| 5,449,221 | A * | 9/1995 | Stander | A47C 16/02 | 297/423.1 |
| 5,642,541 | A | 7/1997 | Corbin | | |
| 6,145,931 | A * | 11/2000 | Subotic | A47C 16/025 | 297/188.11 |
| 6,830,356 | B2 * | 12/2004 | Larocque | A47B 19/10 | 108/23 |
| 6,862,757 | B2 | 3/2005 | Andriunas | | |
| 6,948,777 | B2 * | 9/2005 | Marshall | A47C 7/52 | 297/423.2 |
| 7,013,505 | B2 | 3/2006 | Martin | | |
| 7,317,176 | B2 * | 1/2008 | Boucher | A47C 7/748 | 219/546 |
| 8,286,638 | B1 | 10/2012 | Blackford | | |
| 8,381,333 | B2 | 2/2013 | Friedman | | |
| 8,590,080 | B1 | 11/2013 | Staresinic | | |
| D702,963 | S | 4/2014 | Chavis | | |
| 2005/0151408 | A1 * | 7/2005 | Pratte | A47C 16/025 | 297/423.39 |
| 2007/0001503 | A1 * | 1/2007 | Brady | A47C 16/02 | 297/423.4 |
| 2007/0006808 | A1 | 1/2007 | Scatchard et al. | | |
| 2007/0083991 | A1 | 4/2007 | Cruz | | |
| 2008/0307578 | A1 | 12/2008 | Geremia et al. | | |
| 2009/0050764 | A1 | 2/2009 | Yankovec | | |
| 2009/0070931 | A1 | 3/2009 | DiCristofaro | | |
| 2011/0126353 | A1 | 6/2011 | Veenendaal | | |
| 2012/0102642 | A1 | 5/2012 | Flannery | | |
| 2012/0246824 | A1 | 10/2012 | Friedman | | |
| 2013/0291304 | A1 | 11/2013 | Steinberg | | |
| 2015/0084394 | A1 * | 3/2015 | Hempstead | A47C 7/021 | 297/423.39 |

* cited by examiner

FOOT CARE AND GROOMING APPARATUS THAT CAN BE PLACED UNDERNEATH A MATTRESS OR CUSHION

REFERENCE TO RELATED APPLICATIONS

This utility patent application claims priority to a provisional patent application entitled Foot Care and Grooming Support Tray filed by William Theodore Burch with application No. 62/086,555 and a filing date of Dec. 2, 2014.

FIELD OF THE INVENTION

This disclosure relates to apparatuses and methods used to help a person with their foot care and foot grooming.

BACKGROUND

Outside of professional salons and spas, foot care and grooming can be a frustrating and awkward process. Foot care, at home, is typically accomplished in an awkward fashion by a person sitting on a floor or sitting in a chair with the foot elevated on a table or ottoman. Neither of these typical positions (or other non-spa foot care processes) is especially comfortable or conducive to the person doing an efficacious job of foot care. (The phrase "foot care" is intended to also cover foot grooming and include actions such as toe nail clipping, toe nail filing, nail polish application, painting, polishing, and application of various products to the toes, foot or ankle areas).

What is needed is a way to elevate the foot to be worked upon in such a way that it is comfortable for the person doing the foot care.

Foot care at home is also typically not as organized as one would like since the foot care is done in places where the foot care products are not necessarily easily stored (e.g. on the floor or near the chair the person is using).

What is needed is a way to conveniently store foot care products in a place that is proximate to the person performing the foot care.

SUMMARY

We disclose a foot care apparatus that is comfortable and convenient for the user because it is intended to be removably placed between the box spring and the mattress of a bed or underneath the cushion of a couch or chair. This allows the person using the apparatus to sit comfortably on their bed, couch or chair and insert a portion of the apparatus underneath of the person with another portion extending out beyond the bed or couch with a platform that allows the user to place the foot on the platform in a way that allows for comfortable foot care. In some embodiments the apparatus has compartments for holding and storing foot care products (e.g. nail polish, clippers, files and so forth). The apparatus may be foldable such that it is easily stored when not in use because of its small footprint.

In at least one embodiment the foot care apparatus comprises:

(a) a container portion with at least one interior space where articles can be stored;

(b) a lid portion pivotably connected to the container portion (for example by a hinge) wherein movement of the lid from a closed to an open position allows access to the interior space; and (c) a foot platform portion coupled to the container portion wherein said platform portion is movable into a raised position relative to the container portion (e.g. slanting upward away from the hinge).

In some embodiments the foot platform may be pivotably connected with a support member that is also pivotably connected to the container portion and wherein the support member is constructed and arranged to be positioned proximate to the container portion when the lid is in the closed position and movable to a raised position away from the container portion when the foot platform is in the open position. In the raised position the support member helps keep the foot platform stable even when the user is putting pressure on the foot platform during foot care activities. In some embodiments the foot platform may not pivot upwards and instead be at a fixed position compared to the container portion.

In at least one embodiment of the foot care apparatus, the lid portion has a foam section that is placed so that it aligns with at least part of the interior space in the container portion when the lid is in the closed position. This foam section can help maintain foot care products in a stable position in the interior space of the container portion of the apparatus when the apparatus is in a closed position (i.e. the foam compresses around the foot care products and keeps them in place).

In at least one embodiment of the foot care apparatus there is a tray that may be slidably attached to the container section. When performing foot care, it may be desirable for the tray to be extended so that waste (e.g. clipped toe nails) can be placed in the extended tray.

In at least another embodiment the foot care apparatus may have a detachable light and the detachable light may have a magnifying lens.

A person uses the apparatus disclosed herein by placing the lid section of the open apparatus under a mattress or a cushion and then sitting on the mattress or cushion over the area where the lid has been placed. The user then can raise the foot platform (the platform could be raise before the lid portion is placed under the mattress or cushion). The user then can place their foot upon the foot platform and perform the foot care (e.g. clipping nails, polishing nails and so forth).

In yet another embodiment of the invention disclosed is a foot care method using an apparatus with a first portion (not necessarily a lid) and a second opposing portion (not necessarily a container). The method comprises a user:

(1) inserting the first portion of the apparatus underneath a mattress or a cushion;

(2) sitting on the mattress or the cushion;

(3) placing a foot of the user on the second portion of the apparatus; and (4) performing the foot care.

BRIEF DESCRIPTION OF THE DRAWINGS

FIG. 2(*a*) is a detail view of the sliding connection point between the container portion and the foot platform of the apparatus.

FIG. 4(*a*) is a cut away view of the closed apparatus along line k-k in FIG. 4.

DETAILED DESCRIPTION OF THE DISCLOSURE

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
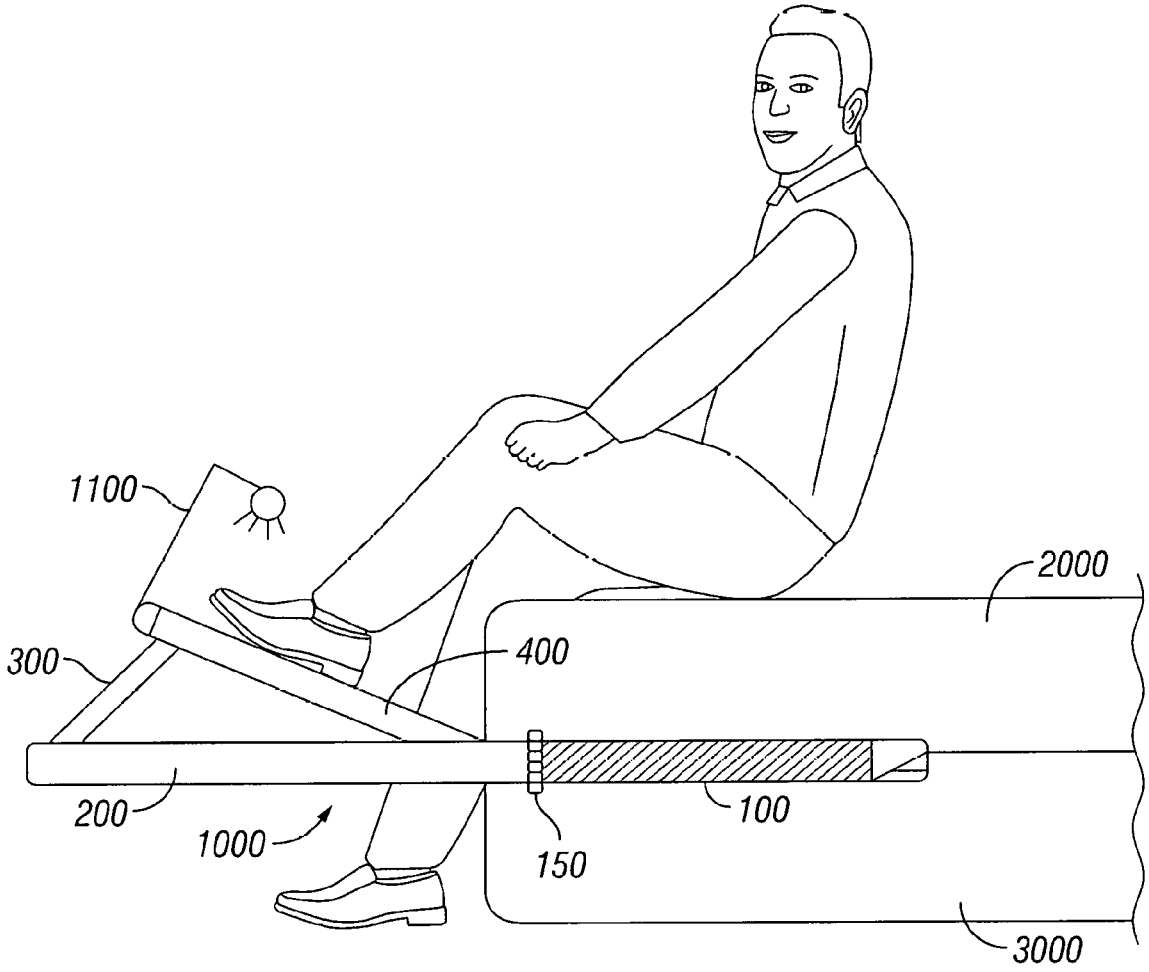
FIG. 1 is a schematic view of the apparatus in use by a person sitting on a bed.

Referring now to FIG. 1, apparatus 1000 of the present invention is shown in use. Lid portion 100 is sized and shaped so that it may be easily inserted between the bed mattress 2000 and bed box spring 3000 (this could also be between a cushion on a couch or chair and the couch or chair body). In some embodiments, as shown in FIG. 1, it may be desirable to insert hinge 150 between mattress 2000 and box spring 3000 in order to protect hinge 150 since it may be the weakest part of apparatus 1000. Most of container portion 200 extends out from under mattress 2000. In FIG. 1, the user has raised foot platform 400 and support member 300 and the person is resting at least one of his feet against foot platform 400 and performing foot care.

Because of the angle of foot platform 400 off the horizontal plane of container 200 and slanted away from hinge 150 and mattress 2000, the person has a comfortable position for foot care. This angle may be anywhere between 15 degrees and 45 degrees from horizontal. The person's weight on mattress 2000 helps push down on lid portion 100 so that it is firmly in place between mattress 2000 and box spring 3000 and this helps prevent movement of apparatus 1000 even when the person is putting pressure on foot platform 400 while performing foot care. FIG. 1 also shows light 1100 positioned to help the user clearly see their feet during foot care. Light 1100 may be easily detachable from apparatus 1000 and light 1100 may also include a magnifying lens. Light 1100 is unlikely to be an integral part of apparatus 1000 and, in any event, apparatus 1000 can be used without a light or magnifying lens.

Figures 2, 2A:
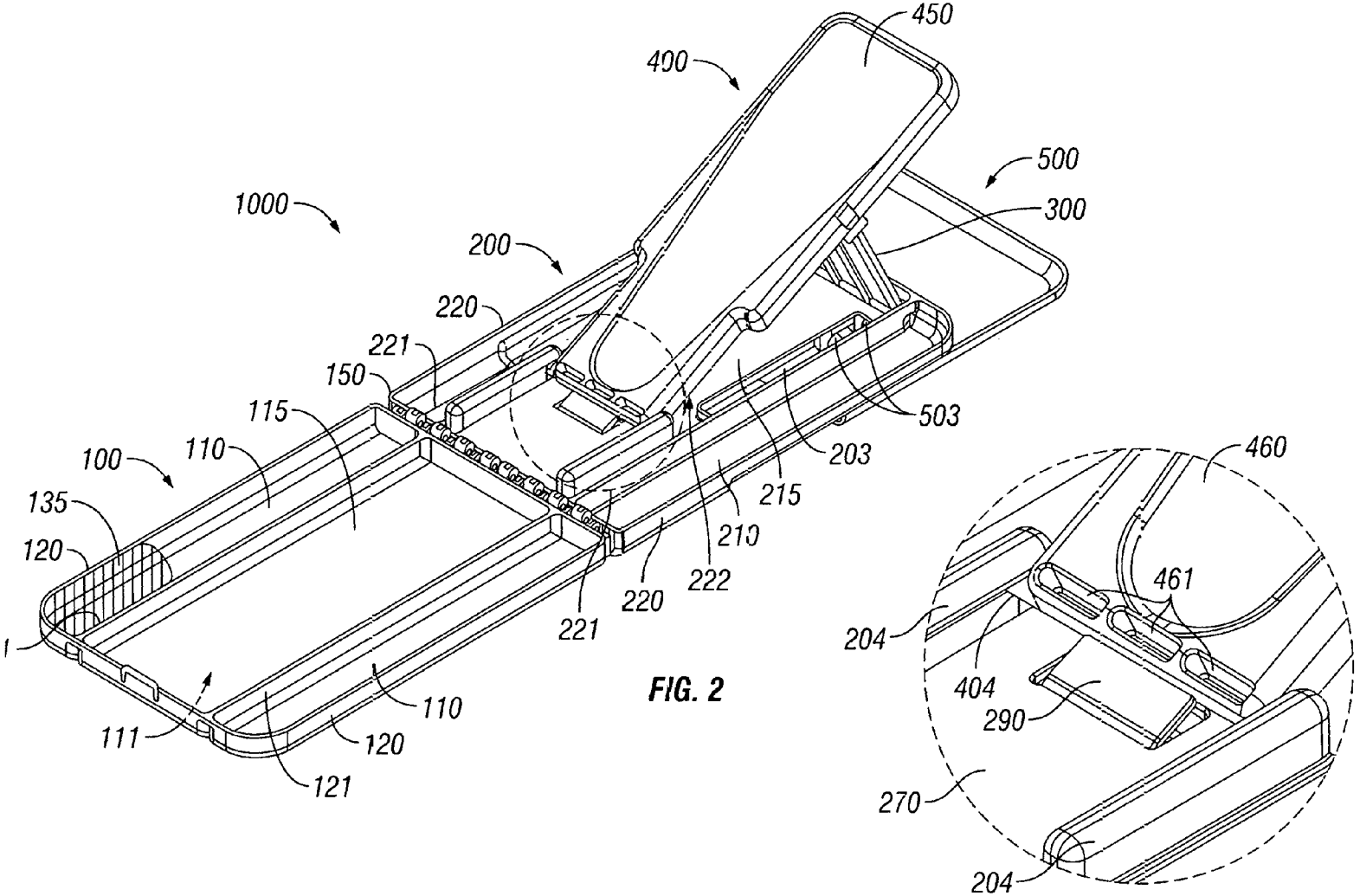
FIG. 2 is a perspective view of the apparatus in an open configuration.

FIG. 2 shows a perspective view of foot care apparatus 1000 in an open configuration. Apparatus 1000 has a container portion 200 with at least one interior space 210 in which foot care articles can be stored, transported and positioned for use during foot care. Apparatus 1000 further may have a container second interior space 215 that is sized and shaped to accept foot platform 400 and support member 300 when the apparatus is a closed position. Apparatus 1000 further includes a lid portion 100 that is pivotably connected to container portion 200. Lid portion 100 is moveable relative to container portion 200 between an opened position and a closed position to permit and prevent access to interior spaces 210 and 215 and to allow foot platform 400 to be accessed and raised. In this open configuration (as shown in FIG. 2) container portion 200 and lid portion 100 are roughly in the same plane because they have been rotated around hinge 150. The hinge structure may comprise any type of pivotal arrangement, such as, for example, a living hinge or pins and hoops.

To form at least one interior space 210 for potentially storing foot care items, interior dividers 221 and outside walls 220 may be constructed and arranged to extend perpendicularly from the plane defined by the bottom panel 222 (see FIG. 3) of container 200. Second container interior space 215, may be formed by interior dividers 221 and can potentially be used as a cavity for foot platform 400 and support 300. To form at least one interior space 110 in lid portion 100, interior dividers 121 and outside walls 120 may be constructed and arranged to extend perpendicularly from the plane defined by the top panel 111 of lid 100 (shown facing downward in FIG. 2 since lid 100 has been pivoted open). Second interior lid space 115 may be formed by interior dividers 121. In certain embodiments, interior dividers 121 and 221 and outside walls 220 120 may be placed so that when apparatus 1000 is in a closed position, the various dividers and walls engage each other to form compartments for storage and transportation of materials and a cavity for the nesting of foot platform 400 and support member 300.

In at least one embodiment, at least a portion of interior space 110 may have compressible material 135, for example a foam, placed into interior space 110 so that when apparatus 1000 is in a closed position, compressible material 115 may contact articles in interior space 210 so that the articles are less likely to be displaced during movement of apparatus 1000.

In one embodiment, apparatus 1000 further comprises slidable tray 500. Tray 500 is attached to the underside of bottom panel 222 and is constructed and arranged to be slidable such that the user may slide tray 500 to the open position so that there is additional storage area for either waste material (e.g. clipped toe nails) or foot care products (e.g. clippers, polish, files and so forth).

In certain embodiments, as shown in FIG. 2, tray 500 is sized and shaped to fit snugly against container portion 200 so that in its retracted position (not shown in FIG. 2) it fits roughly within the same footprint as container portion 200. However, tray 500 may be slidable into an extended position (as shown in FIG. 2) and held slidably in place against container portion 200 because tray 500 may have opposing guide protrusions 503 (see FIG. 3) that are sized and shaped to slide within the elongated openings 203 (see also FIG. 3) in bottom panel 222 of container portion 200. These guides and elongated channels not only allow tray 500 to slide back and forth from a close and open position but also hold tray 500 against container 200 in a horizontal alignment because of spacing of guide protrusions 503 and the hook at an upper end of guide protrusions 503.

Foot platform 400, in FIG. 2 is shown in a raised position. Foot platform 400 has a distal end 450 and a proximal end (see FIG. 2(*a*)) that is closest to hinge 150. Distal end 450 in some embodiments may be wider than proximal end 460. As seen in FIG. 2(*a*) proximal end 460 has platform guide protrusions 404 on opposing sides of proximal end 460 of platform 400 (because of the view in FIG. 2(*a*) one of the opposing protrusions 403 is not visible). Guide protrusions 404 may be of various shapes and sizes (e.g. cylindrical or planar shaped). Proximal end 460 may also have cavities 461. Cavities 461 are there solely to help assure uniform cooling of platform 400 during the injection molding process. Guide protrusions 404 are sized and shaped so that they fit snugly but slidably into elongated foot platform guide tracks 204.

To raise or lower foot platform 400 a user may simply push or pull foot platform 400 in a direction away from or toward hinge 150 so that platform guide protrusions 404 slide along elongated foot platform guide tracks 204 as platform 400 moves away or toward from hinge 150. When moving foot platform 400 away from hinge 150, platform 400 is forced into an elevated and slanted position as compared to the horizontal plane of container portion 200. This elevated and slanted position of platform 400 occurs because of the manner that support member 300 is pivotably attached to both platform 400 and container portion 200.

Figure 3:
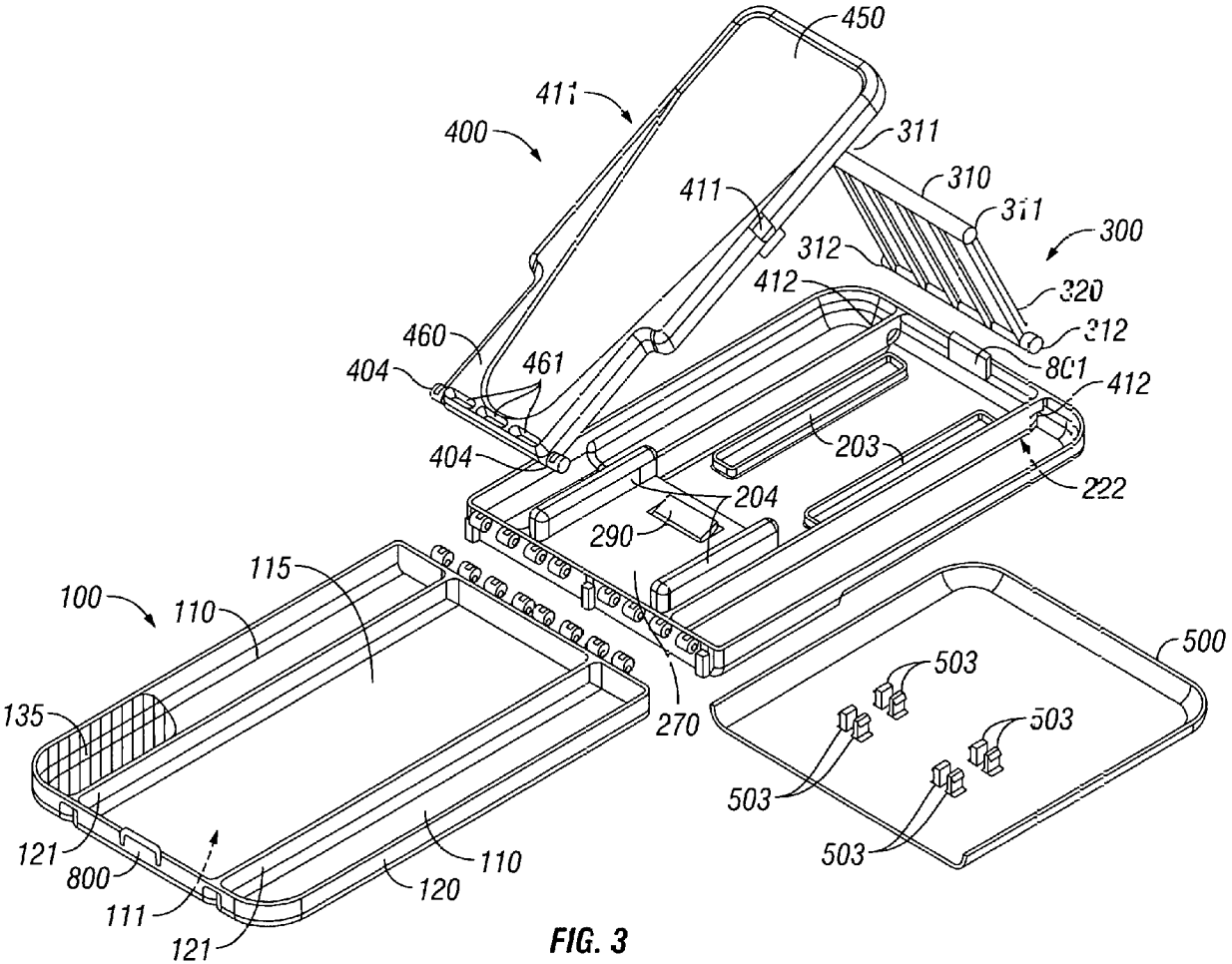
FIG. 3 is an exploded view of the apparatus shown in FIG. 2.

Now looking at FIG. 3, support member 300 has an upper end 310 with opposing pivot points 311 that are pivotably connected to foot platform 400 through opposing openings 411 on either side of platform 400. Support member 300 has a lower end 320 with opposing pivot points 312 that are sized and shaped to sit in openings 412 in dividers 221 of container portion 200.

Figures 4, 4A:
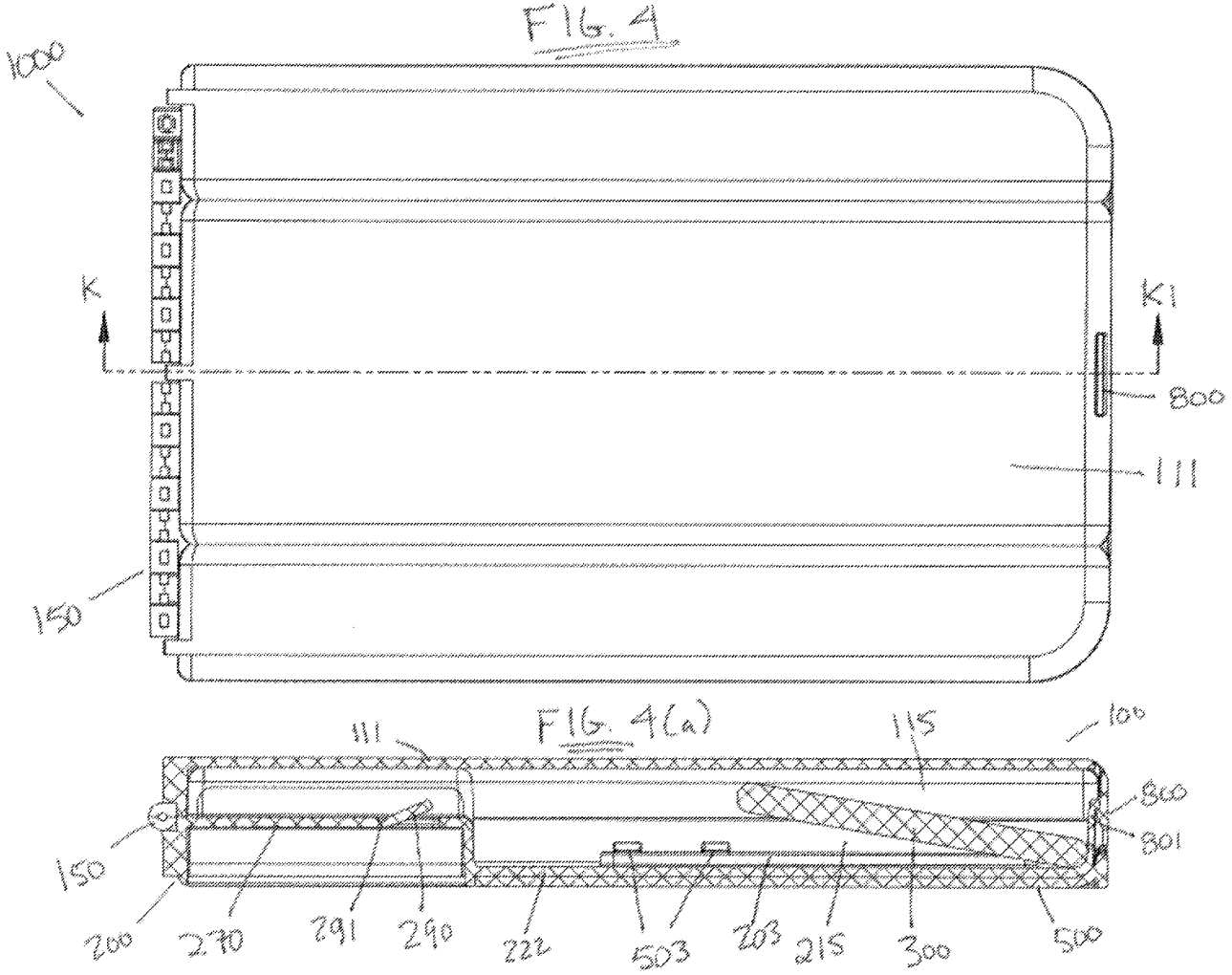
FIG. 4 is a top view of the apparatus when it is in closed position.

To keep platform 400 in a raised position, container 200 has stop 290. As shown in FIGS. 2-4, stop 290 is designed so that in its unbiased position it is elevated above a container surface area 270. When platform 400 is moved into a raised position, proximal end 460 of platform 400 pushes down stop 290 until proximal end 460 passes by stop 290 and at that point stop 290 goes back up into its unbiased raised position. In the unbiased raised position stop 290 prevents platform 400 from moving back down toward hinge 150 because it abuts distal end 460 of platform 400.

In order to lower, platform 400 after use, it may be necessary for the user to push stop 290 down with either their foot or hand so that proximal end 460 can slide back toward hinge 150 thus lowering platform 400 and support member 300 into their nesting positions. In at least one embodiment, stop 290 is an integral part of container portion 200 and it is movable up and down because a pivot point has been included in stop 290. In the embodiment shown in FIG. 4(*a*) stop pivot point 291 is the result of thinner material at a point where pivoting is desired.

As shown in FIG. 4, the closed configuration of apparatus 1000 is relatively compact and the width and length of top panel 111 is consistent with the planar footprint of the entire apparatus 1000. Apparatus 1000 will stay in a closed configuration because of a latch made up of opposing members 800 and 801. The latch can be any of a number of different types of latches (e.g. snap fits, buttons, hook and loop, and so forth).

When in a closed position, as shown in FIG. 4(*a*), the various parts of apparatus 1000 are sized and designed to nest together so that the planar foot print and thickness of apparatus 1000 are minimized. As shown in FIG. 4(*a*) when lid 100 and container portion 200 are pivoted toward one another and in a closed position both support 300 and platform 400 are sized, shaped and designed to nest in the cavity formed when container second interior space 215 and lid second interior space 115 are combined by closing apparatus 1000.

The lid portion 100, container portion 200, foot platform 400, support member 300, slidable tray 500 and/or any other parts of apparatus 1000 may be made of plastic, metal, wood, other materials, or any combination thereof. In some embodiments, these are parts are made of molded plastic.

Although the disclosure has been described in detail for the purpose of illustration, the embodiments described above and shown herein are illustrative and not restrictive. Apparatus 1000 members may optionally be shaped differently and/or may have various sizes and configurations. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein. For example, it is to be understood that the disclosure contemplates that, to the extent possible, one or more features of any embodiment may be combined with one or more features of any other embodiment.

What is claimed is:

1. A foot care apparatus comprising:

(a) a container portion with an interior space;

(b) a foot platform portion pivotally connected to the container portion so that the foot platform portion nests in the interior space when lowered and extends above the interior space when raised; and (c) a lid portion pivotably connected to the container portion so that it can rotate from a close position to an open position and wherein when in a closed position the lid portion and the container portion enclose the foot platform when it is nested in the interior space.

2. The foot care apparatus of claim 1 further comprising a hinge coupling the container portion and the lid portion.

3. The foot care apparatus of claim 2 wherein when the foot platform is in the raised position it is slanted upward away from the hinge.

4. The foot care apparatus of claim 1 wherein the lid portion has a foam section that is placed so that it aligns with at least part of the interior space in the container portion when the lid is in the closed position.

5. The foot care apparatus of claim 1 further comprising an extendable tray that is slidably attached to the container portion.

6. The foot care apparatus of claim 1, further comprising a detachable light.

7. The foot care apparatus of claim 6, wherein the detachable light is coupled to a magnifying glass.

8. The foot care apparatus of claim 1 wherein the lid portion is sized and shaped in a manner so that when the apparatus is in an open position the lid portion can be inserted underneath of a mattress or a cushion.

9. A foot care method using the apparatus described in claim 1 comprising the following steps, in no particular order, taken by a user of the apparatus;

(a) inserting the lid portion of the apparatus underneath of a mattress or a cushion;

(b) sitting on the mattress or the cushion;

(c) raising the foot platform;

(c) placing a foot of the user on the foot platform; and (d) performing the foot care.

* * * * *